US005583391A

United States Patent [19]

Good et al.

[11] Patent Number: 5,583,391

[45] Date of Patent: Dec. 10, 1996

[54] COLOR PICTURE TUBE SHADOW MASK HAVING IMPROVED MASK APERTURE PATTERN

[75] Inventors: Andrew Good, Reamstown; Bruce G. Marks, Lancaster, both of Pa.

[73] Assignee: Thomson Consumer Electronics, Inc., Indianapolis, Ind.

[21] Appl. No.: 558,314

[22] Filed: Nov. 15, 1995

[51] Int. Cl.[6] ..... H01J 29/80

[52] U.S. Cl. ..... 313/402; 313/403; 313/408

[58] Field of Search ..... 313/402, 403, 313/404, 407, 408, 409

[56] References Cited

U.S. PATENT DOCUMENTS

| | | | |
|---|---|---|---|
| 4,127,791 | 11/1978 | Van Lent | 313/403 |
| 4,631,440 | 12/1986 | Robbins | 313/403 |
| 4,727,282 | 2/1988 | Tokita et al. | 313/403 |
| 4,973,879 | 11/1990 | Fujimura | 313/403 |
| 4,983,879 | 1/1991 | Kawaguchi | 313/402 |
| 5,000,711 | 3/1991 | Marks et al. | 445/47 |
| 5,030,881 | 7/1991 | Marks et al. | 313/403 |
| 5,378,959 | 1/1995 | Mancini | 313/402 |

*Primary Examiner*—Sandra L. O'Shea
*Assistant Examiner*—Mack Haynes
*Attorney, Agent, or Firm*—Joseph S. Tripoli; Dennis H. Irlbeck

[57] ABSTRACT

A color picture tube has a rectangular shadow mask mounted therein in spaced relation to a viewing screen. A major axis passes through the center of the mask and parallels the long sides thereof and a minor axis passes through the center of the mask and parallels the short sides thereof. The mask has an aperture array that includes slit-shaped apertures aligned in columns that essentially parallel the minor axis and end at a border of the aperture array. Adjacent apertures in each column are separated by tie bars in the mask that are longitudinally offset from column to adjacent column. The spacing from tie bar to tie bar in a column is the tie bar pitch at a location on the mask. A first set of the aperture columns, comprising every other column, has full length ultimate apertures at least at one end thereof, and a second set of the aperture columns, comprising every other column not in the first set, has partial length ultimate apertures at least at one end thereof. The ultimate apertures of all of the aperture columns end on smooth curved border lines. The tie bar pitch of the columns decreases from the center of the mask to the short sides thereof, with the tie bar pitch in the region of the short sides of the mask being optimized to minimize moiré at the sides of the screen during tube operation. The tie bar pitch along each column varies also from the center of the mask to the long sides of the mask.

1 Claim, 2 Drawing Sheets

COLOR PICTURE TUBE SHADOW MASK HAVING IMPROVED MASK APERTURE PATTERN

This invention relates to color picture tubes having shadow masks with slit-shaped apertures, wherein the apertures are aligned in columns and the apertures in each column are separated by tie bars in the mask; and, particularly, to such a tube wherein the mask has smoothly curved upper and lower borders on the apertured portion thereof and the screen, in operation, exhibits reduced moiré.

BACKGROUND OF THE INVENTION

A predominant number of color picture tubes in use today have line screens and shadow masks that include slit-shaped apertures. The apertures are aligned in columns, and the adjacent apertures in each column are separated from each other by webs or tie bars in the mask. Such tie bars are essential in a the mask, to maintain its integrity when it is formed into a dome-shaped contour which somewhat parallels the contour of the interior of a viewing faceplate of the tube. Tie bars in one column are offset in the longitudinal direction of the column (vertical direction) from the tie bars in the immediately adjacent columns. Because of the pattern of apertures and tie bars, the upper and lower borders of the aperture array are somewhat jagged. Some aperture columns end with tie bars near the border, while other columns end with apertures at the border. When a viewing screen is formed using such a mask as a photomaster, the resultant screen also has jagged upper and lower borders. Such jagged borders are esthetically undesirable.

A technique that produces screens with smooth borders is disclosed in U.S. Pat. No. 4,300,070, issued to R. H. Godfrey et al. on Nov. 10, 1981. In that patent, the aperture array border is smoothed with a elaborate method of lengthening and shortening the pitches of the last two apertures in each column. The method made the border geometry smooth and also equalized the light output at the edges of the screen. However, the method was developed for use with masks having a constant tie bar pitch and a projected straight line border on the screen.

Another technique of eliminating jagged screen borders, for use with a mask having curved upper and lower borders, is disclosed in U.S. Pat. No. 4,631,440, issued to J. D. Robbins on Dec. 23, 1986. In that patent, the upper and lower borders are made smooth by varying the vertical pitch from column-to-column, while keeping the number of apertures per column and the pitch in each individual column constant.

Changes in the aperture pitch in a mask have an effect on a phenomenon called moiré. When electron beams strike the shadow mask, the tie bars block portions of the beams, thus causing shadows on the screen immediately behind the tie bars. When the electron beams are repeatedly scanned in a direction perpendicular to the aperture columns (horizontal direction), they produce a series of bright and dark horizontal lines on the screen. These bright and dark horizontal lines interact with the shadows formed by the tie bars, creating lighter and darker areas and producing a wavy pattern on the screen, called a moiré pattern. Such moiré pattern greatly impairs the visible quality of images displayed on the screen. Therefore, when tie bar pitch is varied, it is highly desirable to select such a pitch that will minimize the moiré pattern.

There have been many techniques suggested to reduce the moiré problem. Most of these techniques involve rearranging the locations of the tie bars in a mask, to reduce the possibility of the electron beam scan lines beating with the tie bar shadows. Although many of these techniques have been used successfully to reduce moiré, they are often incompatible with the desire to obtain smooth clean looking top and bottom screen edges. Therefore, there is yet a need for a shadow mask aperture array pattern that will provide smooth, clean-looking top and bottom screen edges, while simultaneously reducing moiré patterns on a tube screen.

SUMMARY OF THE INVENTION

An improved color picture tube has a shadow mask mounted therein in spaced relation to a viewing screen thereof. The mask has a rectangular periphery with two long sides and two short sides. A major axis passes through the center of the mask and parallels the long sides thereof, and a minor axis passes through the center of the mask and parallels the short sides thereof. The mask has an aperture array that includes slit-shaped apertures aligned in columns that essentially parallel the minor axis and end at a border of the aperture array. Adjacent apertures in each column are separated by tie bars in the mask. The tie bars in one column are offset in the longitudinal direction, paralleling the minor axis, from the tie bars in each adjacent column. The spacing from tie bar to tie bar in a column is the tie bar pitch at a location on the mask. The improvement comprises a first set of columns, comprising every other column, having full length ultimate apertures at least at one end thereof, and a second set of columns, comprising every other column not in the first set, having partial length ultimate apertures at least at one end thereof. The ultimate apertures of all of the aperture columns end on smooth curved border lines. The tie bar pitch of the columns decreases from the center of the mask to the short sides of the mask, with the tie bar pitch in the region of the short sides being optimized to minimize moiré at the sides of the screen during tube operation. The tie bar pitch along each column is varied also from the center of the mask to the long sides of the mask.

DETAILED DESCRIPTION OF THE PREFERRED EMBODIMENTS

Figure 1:
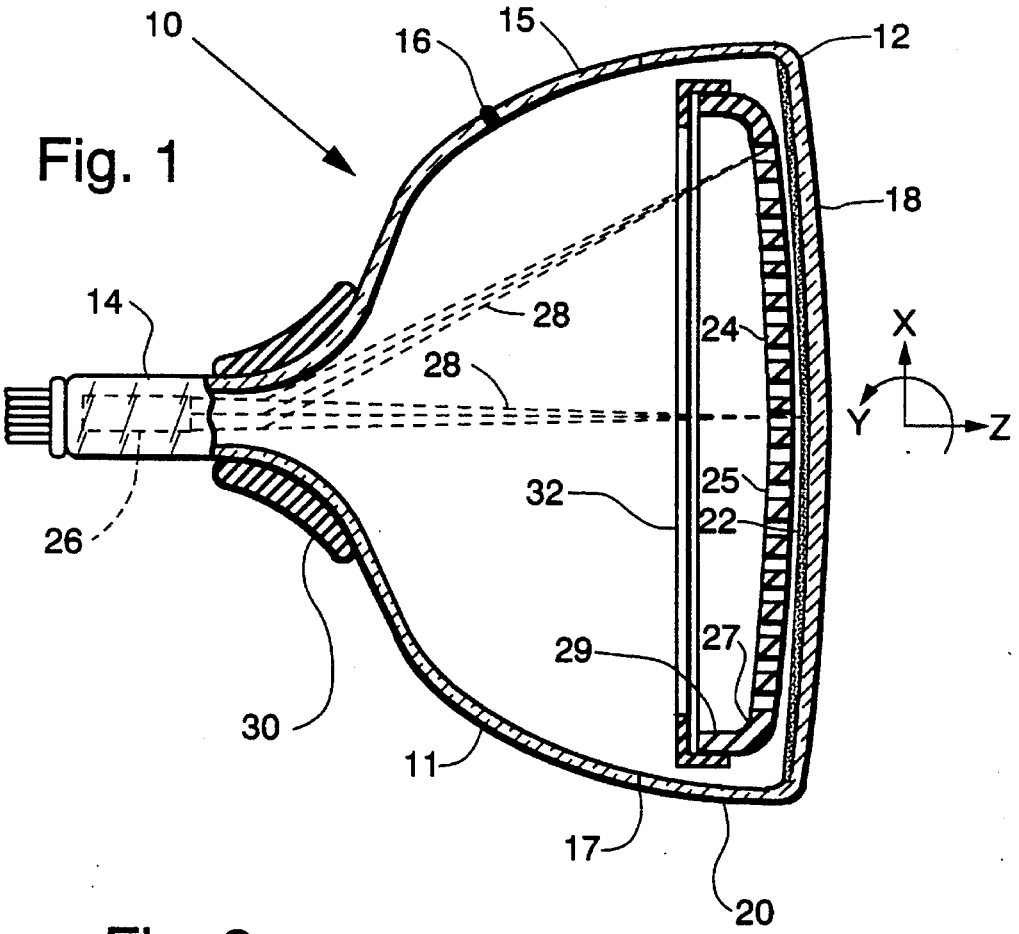
FIG. 1 is an axially sectioned side view of a color picture tube embodying the present invention.

FIG. 1 shows a rectangular color picture tube 10 having a glass envelope 11 comprising a rectangular faceplate panel 12 and a tubular neck 14 connected by a rectangular funnel 15. The funnel 15 has an internal conductive coating (not shown) that extends from an anode button 16 to the neck 14. The panel 12 comprises a viewing faceplate 18 and a peripheral flange or sidewall 20, which is sealed to the funnel 15 by a glass frit 17. A three-color phosphor screen 22 is carried by the inner surface of the faceplate 18. The screen 22 is a line screen, with the phosphor lines arranged in triads, each triad including a phosphor line of each of the three colors. A multi-apertured color selection electrode or shadow mask 24 is removably mounted, by conventional means, in predetermined spaced relation to the screen 22. An electron gun 26, shown schematically by dashed lines in FIG. 1, is centrally mounted within the neck 14 to generate and direct three electron beams 28 along convergent paths through the mask 24 to the screen 22.

The tube of FIG. 1 is designed to be used with an external magnetic deflection yoke, such as the yoke 30 shown in the neighborhood of the funnel-to-neck junction. When activated, the yoke 30 subjects the three beams 28 to magnetic fields which cause the beams to scan horizontally and vertically in a rectangular raster over the screen 22. The initial plane of deflection (at zero deflection) is at about the middle of the yoke 30. Because of fringe fields, the zone of deflection of the tube extends axially from the yoke 30 into the region of the gun 26. For simplicity, the actual curvatures of the deflected beam paths in the deflection zone are not shown in FIG. 1.

The shadow mask 24 is part of a mask-frame assembly 32 that also includes a peripheral frame 34. The mask-frame assembly 32 is shown positioned within the faceplate panel 12 in FIG. 1, and in front view in FIG. 2. The shadow mask 24 includes a curved apertured portion 25, an imperforate edge portion 27 surrounding the apertured portion 25, and a skirt portion 29 bent back from the edge portion 27 and extending away from the screen 22. The mask 24 is telescoped within the frame 34, and the skirt portion 29 is welded to the frame 34.

Figure 2:
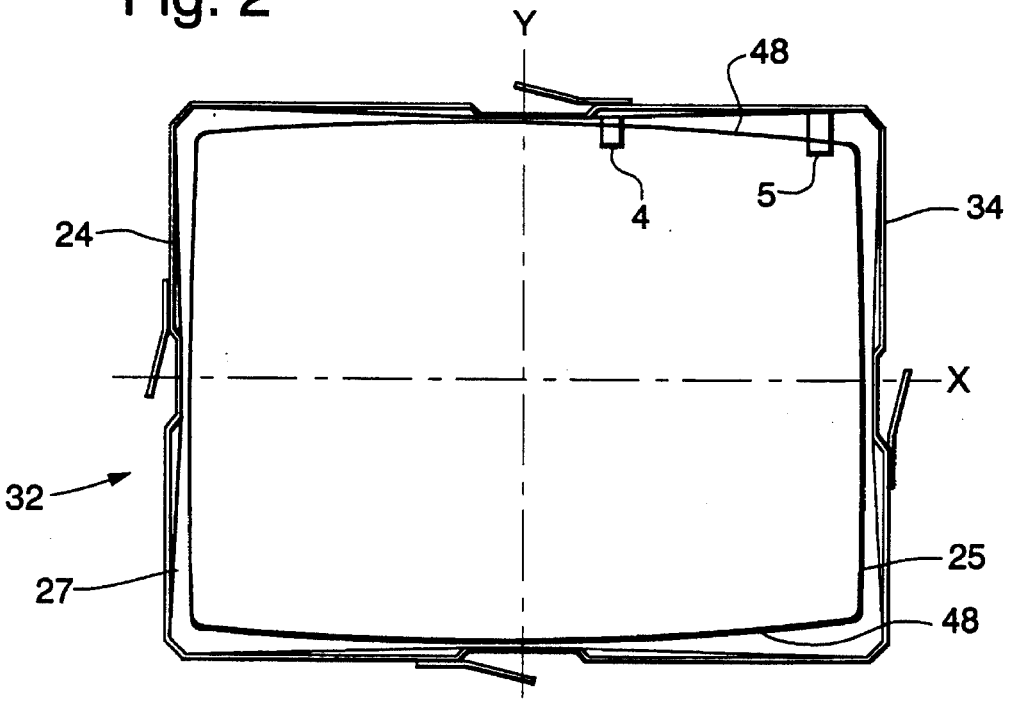
FIG. 2 is front plan view of a mask-frame assembly of the tube of FIG. 1.
Figure 3:
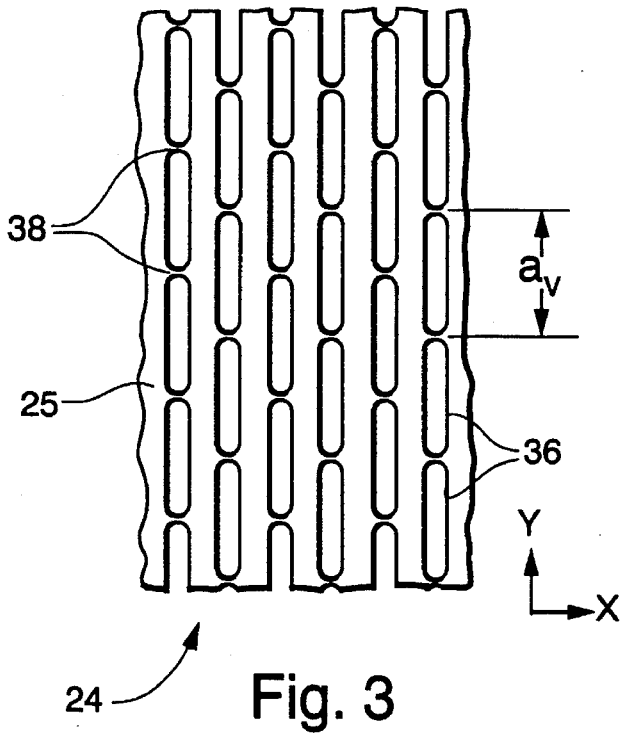
FIG. 3 is an enlarged view of a small portion of a shadow mask of the tube of FIG. 1.

As shown in FIG. 2, the mask 24 has a major axis X, which passes through the center of the mask and parallels the long sides thereof, and a minor axis Y, which passes through the center of the mask and parallels the short sides thereof. As shown in FIG. 3, the mask 24 includes slit-shaped apertures 36 aligned in columns that essentially parallel the minor axis Y. Adjacent apertures 36 in each column are separated by tie bars 38 in the mask, with the spacing between centers of adjacent tie bars 38 in a column being defined as the tie bar pitch $a_v$ at a particular location on the mask.

Figure 4:
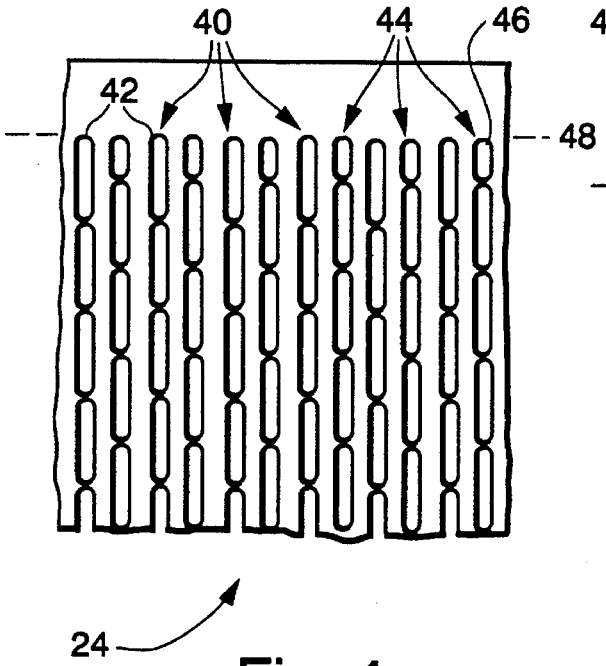
FIG. 4 is an enlarged view of a portion of the shadow mask taken at rectangle 4 of FIG. 2.
Figure 5:
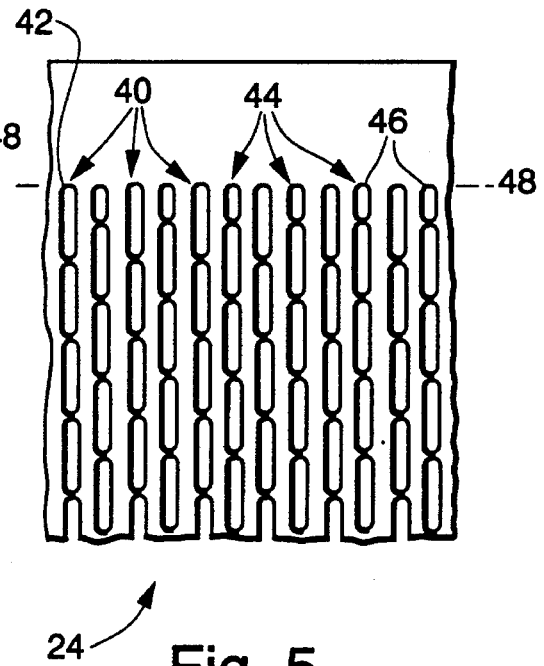
FIG. 5 is an enlarged view of a portion of the shadow mask taken at rectangle 5 of FIG. 2.

In a preferred embodiment of the mask 24, the tie bar pitch is varied both in the direction of the major axis X and in the direction of the minor axis Y, in order to achieve clean looking top and bottom screen borders and to provide good moiré performance over the screen. The mask 24, as shown in FIGS. 4 and 5, includes a first set of aperture columns 40, comprising every other column, having full length ultimate apertures 42 at least at one end thereof, and a second set of aperture columns 44, comprising every other column not in the first set, having partial length ultimate apertures 46 at least at one end thereof. The ultimate apertures of all of the aperture columns end on smoothly curved border lines 48. The smoothly curved border lines 48 are obtained by gradually decreasing the tie bar pitch of the columns from the center of the mask to the short sides of the mask, so that the tie bar pitch in the mask portion shown in FIG. 5 is less than is the tie bar pitch in the mask portion shown in FIG. 4. Because the area of the most severe moiré is at the short sides of the screen, the tie bar pitch in the region of the short sides of the mask is optimized to minimize moiré thereat during tube operation. With the tie bar pitch so optimized, an additional technique is required to reduce moiré in other portions of the screen. In the mask 24, this additional technique is to vary the tie bar pitch along each column from the center of the mask to the long sides of the mask. Generally, this tie bar pitch variation is a gradual decrease in tie bar pitch from the center to each long side of the mask.

The tie bars in alternate columns lie in slightly curved rows on an unformed flat mask. When the flat mask is formed into a contoured mask, these tie bar rows essentially parallel the electron beam scan lines. The minor axis intercept of any tie bar row is determined by the following equation:

$$Y_0=\Sigma_i A(i)\cdot 10^{P}[\text{row no.}]^{(i)},$$

where "$Y_0$" is the distance along the minor axis from the major axis X, "A(i)" is a coefficient which varies with tube type, "P" represents a power of 10, "row no." is the number of any tie bar row counted from the major axis X, and "i" is a number from 1 to 8. The following table lists the coefficients A(i), in millimeters, and powers P for a tube having a viewing screen with a 4/3 aspect ratio and a diagonal of 48 cm (19 inches).

| i | A(i) | P |
|---|---|---|
| 1 | +9.975822133442 | −01 |
| 2 | −3.236410711583 | −06 |
| 3 | +6.046184314904 | −07 |
| 4 | −5.904474762096 | −10 |

The vertical distance "Y" from any tie bar row to the major axis X, at any point off of the minor axis, is determined by the following equation:

$$Y=Y_0+Y_D,$$

where $$Y_D=\Sigma_n C(n)\cdot 10^{P}(Y_0)^{j}(X)^{k},$$

and where "n" is a number from 1 to 72, "C(n)" is a coefficient which varies with tube type, "P" represents a power of 10, "X" is distance along the major axis, and "j" and "k" are powers of $Y_0$ and X, respectively, j and k each varying from 1 to 5.

The following table lists the coefficients C(n), in millimeters, powers P, the j powers of $Y_0$ and the k powers of X, for a tube having a 4/3 aspect ratio and a viewing screen diagonal of 48 cm (19 inches).

| n | C(n) | P | i | k |
|---|---|---|---|---|
| 1 | −1.889623949890 | −06 | 1 | 2 |
| 2 | +4.165471142317 | −12 | 3 | 2 |
| 3 | +2.920387672196 | −16 | 5 | 2 |
| 4 | +4.293817663233 | −12 | 1 | 4 |
| 5 | −1.910781695200 | −16 | 3 | 4 |
| 6 | +3.897252179733 | −21 | 5 | 4 |

What is claimed is:

1. In a color picture tube having a shadow mask mounted therein in spaced relation to a viewing screen thereof, said mask having a rectangular periphery with two long sides and two short sides, a major axis thereof passing through the center of said mask and paralleling said long sides and a minor axis thereof passing through the center of said mask and paralleling said short sides, and said mask having an aperture array including slit-shaped apertures aligned in columns that essentially parallel said minor axis and end at a border of the aperture array, adjacent apertures in each column being separated by tie bars in said mask, the tie bars in one column being offset in a longitudinal direction, paralleling said minor axis, from the tie bars in each adjacent column, and the spacing form tie bar to tie bar in a column being the tie bar pitch at a location on the mask, the improvement comprising a first set of said columns, comprising every other column, having full length ultimate apertures at least at one end thereof, and a second set of said columns, comprising every other column not in said first set, having partial length ultimate apertures at least at one end thereof, the ultimate apertures of all of said aperture columns ending on smooth curved border lines, and the tie bar pitch of said columns decreasing from said center of said mask to said short sides thereof, and wherein the tie bar pitch along each column varies from the center of said mask to said long sides thereof.

* * * * *